US008490838B2

(12) United States Patent
Hall et al.

(10) Patent No.: US 8,490,838 B2
(45) Date of Patent: Jul. 23, 2013

(54) LIQUID DISPENSER

(75) Inventors: Mark Hall, Murrieta, CA (US); Jeff Hoover, Hermosa Bch, CA (US); Dan Lamb, Murrieta, CA (US)

(73) Assignee: Monster Energy Company, Corona, CA (US)

( * ) Notice: Subject to any disclaimer, the term of this patent is extended or adjusted under 35 U.S.C. 154(b) by 923 days.

(21) Appl. No.: 12/172,911

(22) Filed: Jul. 14, 2008

(65) Prior Publication Data

US 2009/0145929 A1 Jun. 11, 2009

Related U.S. Application Data

(60) Provisional application No. 60/949,824, filed on Jul. 13, 2007, provisional application No. 61/037,969, filed on Mar. 19, 2008.

(51) Int. Cl.
*B67D 7/06* (2010.01)

(52) U.S. Cl.
USPC ..... 222/183; 222/570; 222/573; 220/737

(58) Field of Classification Search
USPC ..... 248/95, 102; 222/179.5, 183, 563, 222/567, 570, 573, 180, 130–131; 215/387, 215/395; 220/4.04, 203.09, 568–569, 592.16–592.18, 703, 737, 741–742, 906–907
See application file for complete search history.

(56) References Cited

U.S. PATENT DOCUMENTS

| | | | | |
|---|---|---|---|---|
| 1,351,330 | A * | 8/1920 | Herschmann | 222/131 |
| 1,887,881 | A * | 11/1932 | Blattner | 222/166 |
| 3,161,326 | A * | 12/1964 | Parr | 222/183 |
| 3,338,482 | A | 8/1967 | Jordan | |
| 3,719,305 | A | 3/1973 | Pressnell | |
| 3,784,059 | A | 1/1974 | Katzakian | |
| 3,871,555 | A * | 3/1975 | Collins | 222/131 |

(Continued)

FOREIGN PATENT DOCUMENTS

| | | |
|---|---|---|
| EP | 0438789 | 7/1991 |
| WO | WO 2009/012100 | 1/2009 |

OTHER PUBLICATIONS

Young, L., International Search Report, Oct. 1, 2008.

(Continued)

*Primary Examiner* — Kevin P Shaver
*Assistant Examiner* — Andrew P Bainbridge
(74) *Attorney, Agent, or Firm* — Knobbe, Martens, Olson & Bear, LLP

(57) ABSTRACT

A cocktail ingredient dispenser can include engaging devices for creating a seal around an opening of a carbonated liquid container and for providing an openable and closeable opening which can retain the carbonation within the carbonated liquid when closed. Some embodiments of the dispenser are configured to maintain a gas tight seal with a top portion of the container. Certain embodiments of the dispenser are configured to allow a cooled fluid to flow into thermal communication with the container.

22 Claims, 6 Drawing Sheets

U.S. PATENT DOCUMENTS

| | | | | |
|---|---|---|---|---|
| 4,452,381 | A | 6/1984 | Freeman | |
| 4,823,975 | A | 4/1989 | Schwankl | |
| 4,883,192 | A | 11/1989 | Krugman | |
| 5,071,042 | A * | 12/1991 | Esposito | 222/570 |
| 5,732,851 | A | 3/1998 | Griffin et al. | |
| 5,947,324 | A | 9/1999 | Palinchak | |
| 6,155,452 | A | 12/2000 | Laurent | |
| 6,311,865 | B1 | 11/2001 | Laurent | |
| 6,540,111 | B2 | 4/2003 | Sunnarborg | |
| 2003/0070447 | A1 | 4/2003 | Tanaka | |
| 2003/0168474 | A1 * | 9/2003 | Widgery | 222/183 |
| 2003/0230575 | A1 | 12/2003 | Laurent | |
| 2006/0118578 | A1 * | 6/2006 | Mineau | 222/182 |
| 2006/0151426 | A1 | 7/2006 | Peters | |

OTHER PUBLICATIONS

Young, L., Written Opinion of the International Searching Authority, Oct. 1, 2008.

Strietelmeier, J., QuikTop Review (online), May 13, 2003 (retrieved Sep. 22, 2008), URL: http://the-gadgeteer.com/review/quiktop_review.

Extended European Search Report in corresponding European Application No. 08012581.8, dated Nov. 10, 2008, 8 pages.

International Preliminary Report on Patentability in corresponding International Patent Application No. PCT/US2008/069542, mailed Jan. 28, 2010, 6 pages.

* cited by examiner

LIQUID DISPENSER

RELATED APPLICATIONS

The present application is based on and claims priority under 35 U.S.C. §119(e) to U.S. Provisional Application No. 60/949,824, filed on Jul. 13, 2007 and U.S. Provisional Application No. 61/037,969, filed on Mar. 19, 2008, the entire contents of both are incorporated by reference herein.

BACKGROUND OF THE INVENTIONS

1. Field of the Inventions

The present inventions are directed to dispensers for liquids, such as ingredients of cocktails, and more particularly, carbonated ingredients or ingredients that are to be kept refrigerated or otherwise chilled in, for example, an ice-water bath or other cooled environments.

2. Description of the Related Art

Aluminum cans have long been used for containing carbonated drinks, such as sodas, energy drinks, and other pressurized beverages. Typically, these cans include a tab-type opener in which the tab is used to depress a portion of the top of the can outlined by a frangible portion such that the frangible portion is broken when the can is opened. However, after the can is opened, the carbonation is released gradually over time. Thus, these cans are intended to be used in the manner in which the entire contents of the can are used soon after the can is opened.

In order to slow the release of carbonation from such cans, various devices have been developed for forming a seal over the opening of these types of cans. Some of these devices include removable caps that fit on the top end of the beverage can and include lip seals that form a gas-tight seal over the top of a can so as to prevent carbonation from escaping from the beverage.

SUMMARY OF THE INVENTIONS

In some embodiments, a dispenser is configured to extend around and engage a container which includes an opening. The dispenser can include a seal that surrounds the opening. Additionally, the dispenser can include at least one opening on a portion thereof, so as to allow fluid to move into thermal communication with the container.

In accordance with another embodiment, a canned cocktail ingredient dispenser can comprise a metal can containing a carbonated cocktail ingredient, the metal can comprising a top portion and a frangible portion disposed on the top portion and configured to allow a user to open the top portion. A top tensioning member can have a first connector, the top tensioning member including a sealing arrangement configured to form a seal with the top portion of the metal can around the frangible portion. A bottom tensioning member can have a bottom abutment portion configured to abut against a bottom of the metal can. A second connector can be configured to releasably engage the first connector. A middle portion can be disposed between the bottom abutment portion and the second connector, the top tensioning member, the bottom tensioning member and the first and second connectors being arranged such that the bottom tensioning member presses the top portion of the metal can into engagement with the seal on the top tensioning member with sufficient force so as to maintain a gas tight seal between the seal and the top portion of the can that is sufficiently strong to maintain the carbonation in the can. The middle portion can be open such that fluid can freely flow into thermal communication with portions of the metal can below the seal.

In accordance with another embodiment, a carbonated liquid dispenser can comprise a top member including a seal configured to form a seal with a top portion of a carbonated liquid container and around an opening in the top portion of the carbonated liquid container. A bottom member can have a bottom portion configured to abut against a bottom of the carbonated liquid container. A middle portion can connect the bottom portion and the top member. The middle portion can be open such that fluid can freely flow into thermal communication with portions of the carbonated liquid container.

In accordance with yet another embodiment, a carbonated liquid dispenser can comprise a top member including a seal configured to form a seal with a top portion of a carbonated liquid container and around an opening in the top portion of the carbonated liquid container. A bottom member can have a bottom portion configured to abut against a bottom of the carbonated liquid container. A middle portion connecting the bottom member and the top member and the dispenser can also include means for allowing fluid to freely flow into thermal communication with portions of the carbonated liquid container.

In accordance with a further embodiment, a method of sealing an opened carbonated liquid container can be provided. The method can comprise inserting the carbonated liquid container into a bottom member which includes at least one opening in a side thereof and abutting a bottom portion of the bottom member against a bottom of the carbonated liquid container. The method can further include connecting a top member to the bottom member with the carbonated liquid container disposed between the top and bottom members such that a seal is formed between the top member and a top of the carbonated liquid container, the seal being positioned around an opening in the top of the carbonated liquid container. The method can also include inserting at least the bottom member into a cooled fluid such that the cooled fluid flows through the at least one opening and into thermal communication with the carbonated liquid container.

BRIEF DESCRIPTION OF THE DRAWINGS

Certain embodiments of the present inventions are discussed below in detail with reference to the following figures. These figures are provided for illustrative purposes only, and the inventions are not limited to the subject matter illustrated in the figures.

DETAILED DESCRIPTION OF THE PREFERRED EMBODIMENTS

FIGS. 1-5 illustrate embodiments of a liquid dispenser 10. The liquid dispenser 10 is illustrated and described in the context of a dispenser for use with carbonated beverages contained in aluminum cans. However, this is merely one exemplary environment in which the present inventions can be used. The inventions and embodiments disclosed herein can be used in other contexts as well.

Figure 1:
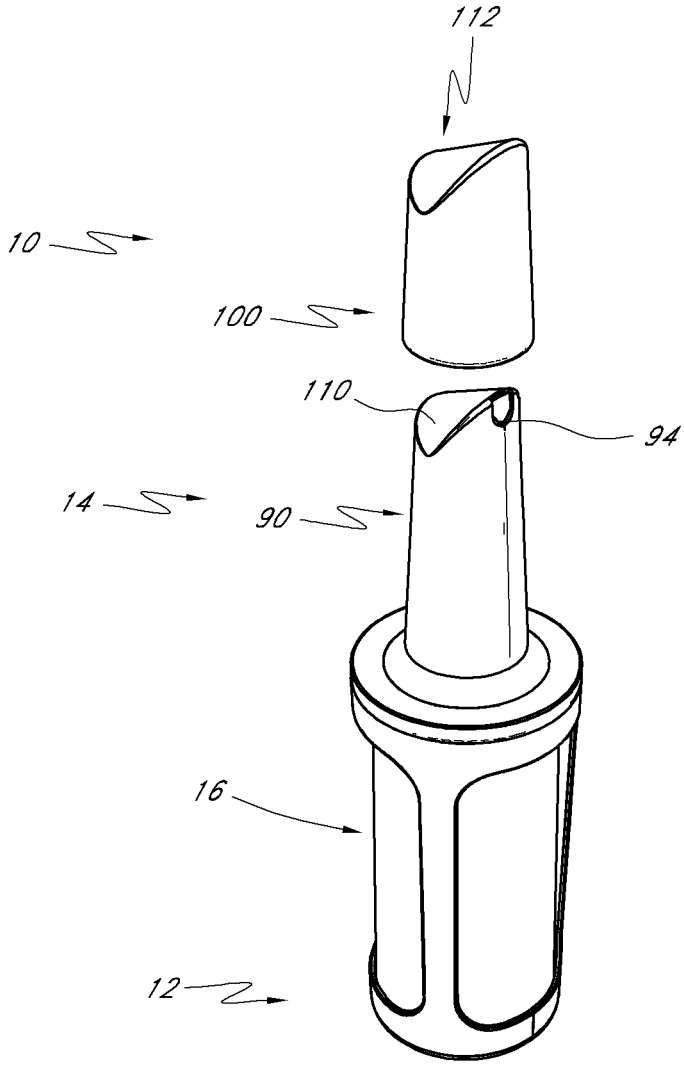
FIG. 1 is a perspective and partial exploded view of a cocktail ingredient dispenser in accordance with an embodiment.

With reference to FIG. 1, a liquid dispenser 10 can include a lower portion 12 and an upper portion 14. The lower and upper portions 12, 14 can be configured to retain a carbonated beverage container 16 therebetween. In some embodiments, the carbonated liquid container 16 can be a soda can, a juice container, etc.

Figure 2:
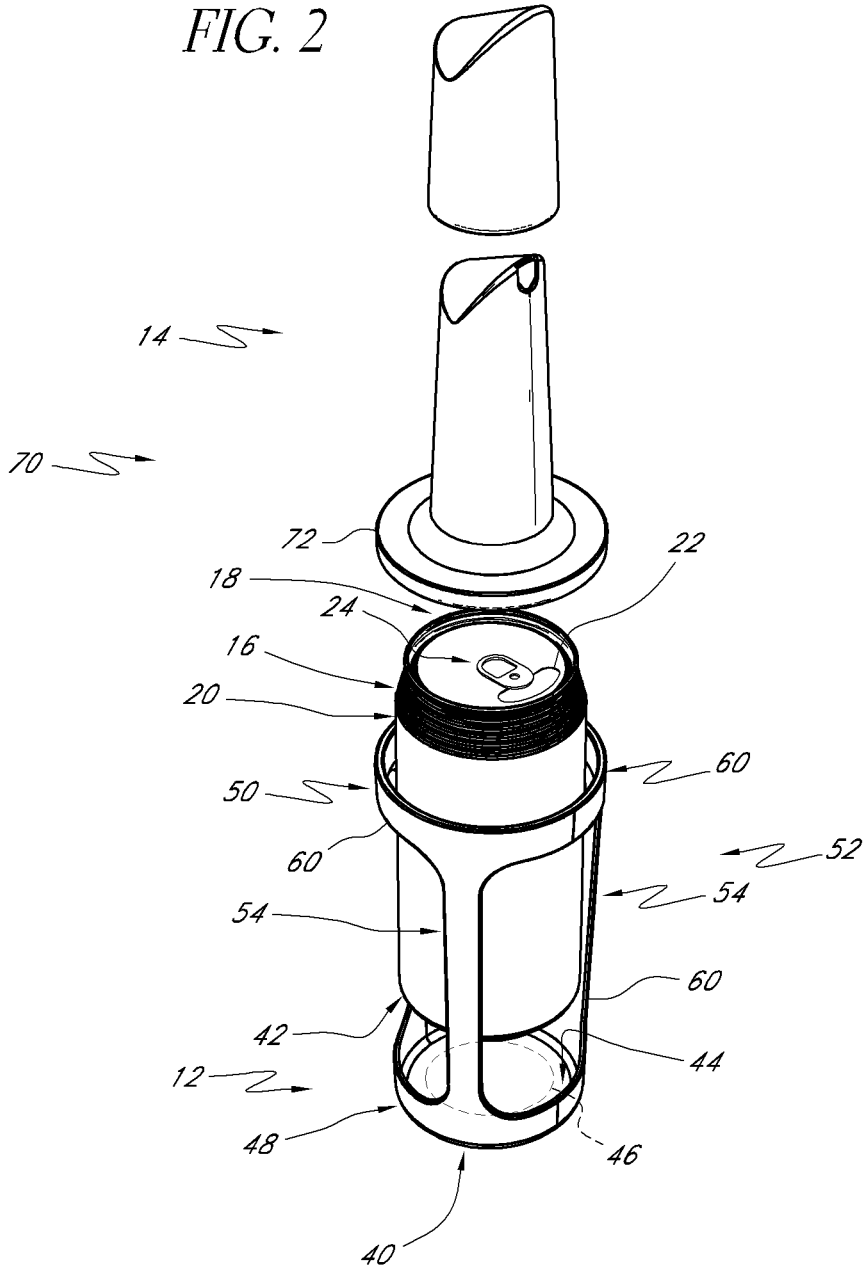
FIG. 2 is an exploded perspective view of the dispenser illustrated in FIG. 1.

For example, with reference to FIG. 2, the carbonated liquid container 16 can be in the configuration of the long known and widely used "soda can" configuration. The illustrated container 16 can be an aluminum can having a top 18 connected to a sidewall 20. The top 18 can include a frangible portion 22. A snap top lever 24 can also be attached to the top 18 so as to provide a convenient device allowing a user to break the frangible portion 22 to open the top 18 of the container 16.

The dispenser 10 can be used with other types of cans. For example, pineapple juice cans are available in a large size format. Typically, these cans are opened with a piercing-type can opener. Once opened, however, bartenders often transfer this type of juice into an opaque plastic juice container with an elongated neck. However, because of the opacity of these types of plastic containers, it is difficult to determine the precise color of the contents. For example, it is difficult to distinguish pineapple juice from orange juice in the low-light environment of a bar or night club.

Thus, by taking a large pineapple can which was opened using a piercing-type can opener, and placing it into the dispenser, the original label on the pineapple can is still visible to the bartender and thus more easily distinguishable from an orange juice container. Additionally, the bartender is not required to transfer the pineapple juice to another container, thereby saving time. Additionally, the dispenser 10 can be used with other types of cans as well.

Figure 3:
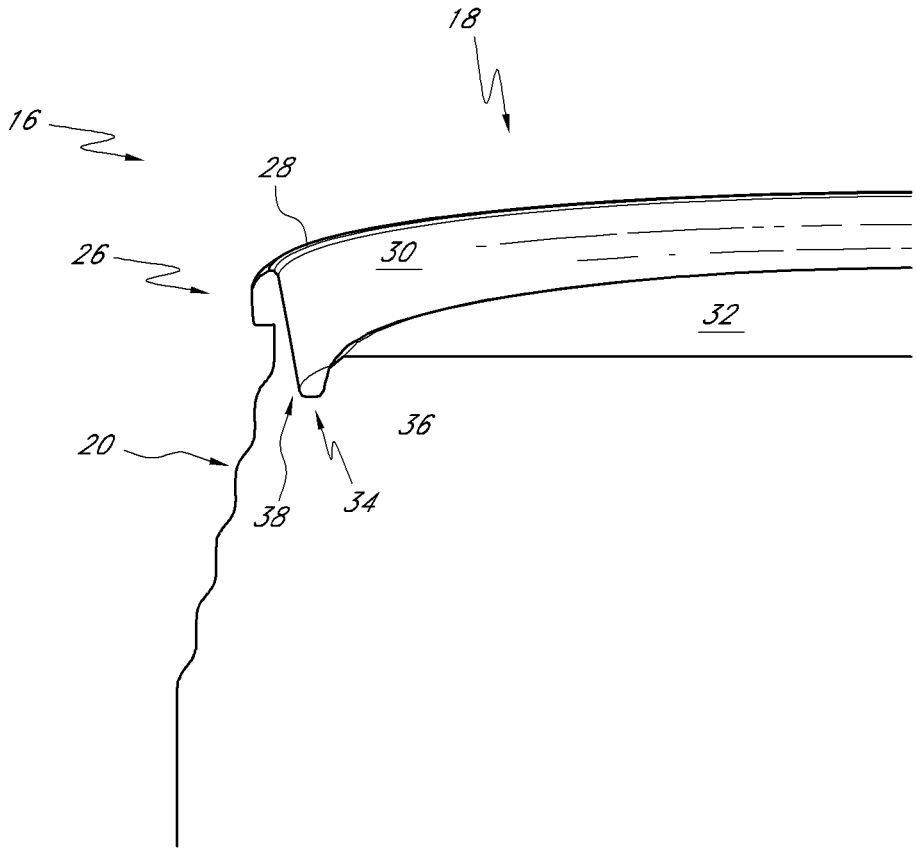
FIG. 3 is an enlarged sectional view of a carbonated liquid container disposed within the ingredient dispenser of FIGS. 1 and 2.

With reference to FIG. 3, as is typical in the carbonated beverage container arts, the sidewall 20 of the container 16 can be connected to the top 18 along an upstanding wall 26. The upstanding wall 26 can include a bead 28 along its top edge and inwardly facing wall 30.

The top 18 can also include a central area 32 upon which the frangible portion 20 and lever 24 (FIG. 2) can be disposed. The central portion 32 and the inwardly facing wall 30 can meet along a channel 34. As illustrated in FIG. 3, the channel 34 can be defined by an outwardly facing wall 36 disposed along the peripheral edge of the central portion 32 and a lower portion 38 of the inwardly facing wall 30.

The container 16 can be any size. For example, the container 16 can be 8, 8.3, 12, 16, 24, or 32 fluid ounces, although any size container 16 can be used. Further, advantages can be achieved where the container 16 is about 32 ounces. For example, "on premises" alcohol establishments are serving many new cocktails.

Energy drinks are now being used as mixers for cocktails. Many of these energy drinks come in various sized aluminum cans. Some of these energy drinks come in cans as small as 8 ounces. However, such a small can generates a large amount of waste, i.e., an 8 ounce can contains enough soda for only about 1-2 cocktails. In some establishments, bartenders keep large garbage cans behind the bars to collect used cans.

Using a larger can greatly reduces the amount of used cans generated per cocktail. For example, a larger can has a greater volumetric efficiency than a smaller can. More particularly, the ratio of aluminum mass per fluid ounce is lower for a larger can than it is for a smaller can. As such, more aluminum is required to manufacture eight 8-ounce aluminum cans (totaling 64 ounces) than that required to make two 32-ounce cans (totaling 64 ounces).

However, a 32 ounce can can be used to make as many as eight or more cocktails. Thus, once a 32-ounce can is opened, it may remain open for an extended period of time, until enough cocktails have been ordered to deplete the liquid from the 32-ounce can. The longer the can is opened, the more carbonation will be lost unless it is sealed. Additionally, the contents of the can will become warmer over time. Thus, in some embodiments, the liquid dispenser 10 can maintain the carbonation within the can and preferably allow the can to be cooled using equipment already existing in the on-premises alcohol market. Thus, with reference to FIG. 1, further advantages can be achieved where the dispenser 10 is configured to receive a container 16 that is larger than 16 fluid ounces, for example, cans having capacities up to about 32 ounces or more.

Additionally, further advantages can also be achieved where the dispenser 10 is configured to allow fluid to flow into thermal communication with the container 16. As such, a bartender can keep the container 16 chilled using existing equipment, such as refrigerators or ice water baths that are widely used in on-premises alcohol establishments.

With reference to FIG. 2, the lower portion 12 can have an inner diameter configured to receive any size container 16. In some embodiments, the inner diameter of the lower portion 12 is sized to receive a container of about 2½ inches. Further, in some embodiments, the lower portion 12 is configured to receive a container 16 having a diameter of 3 or more inches. In an exemplary embodiment, where the container 16 has a capacity of about 32 fluid ounces, the inner diameter of the lower portion 12 can be about 3½ inches. However, this is merely an exemplary and non-limiting embodiment.

With reference to FIG. 2, the lower portion 12 can include an abutment portion 40 that is configured to abut against a bottom 42 of the container 16. In some embodiments, the abutment portion 40 can include a generally flat inner surface 44. However, in other embodiments, the inner surface 44 can have any shape. Additionally, the lower portion 12 can include an outermost peripheral wall 48 that extends around the entire periphery of the lower surface 44.

When the container abuts against the surface 44, it can contact the surface along a contact area, schematically represented by phantom line 49. This contact area can form a liquid barrier when the container 16 is pressed against the surface 44. As such, water or other liquids can accumulate between the peripheral wall 48 and the side of the container 16 (FIGS. 4 and 5).

In some embodiments, the lower portion 12 can include an opening 46 (illustrated in phantom line in FIG. 4 and solid line in FIG. 5)). As such, any water that may flow into the lower portion 12, can quickly drain out therefrom. Additionally, with reference to FIG. 4, the opening 46 can allow fluid, such as air or water, to contact a lower surface of the container 16, in the vicinity of the recess 47, and thereby aid in cooling the contents of the container 16. Additionally, in some embodiments, the lower portion 12 can also include one or more drain holes 45 (FIG. 5) so aid in draining water from the dispenser 10.

Figure 4:
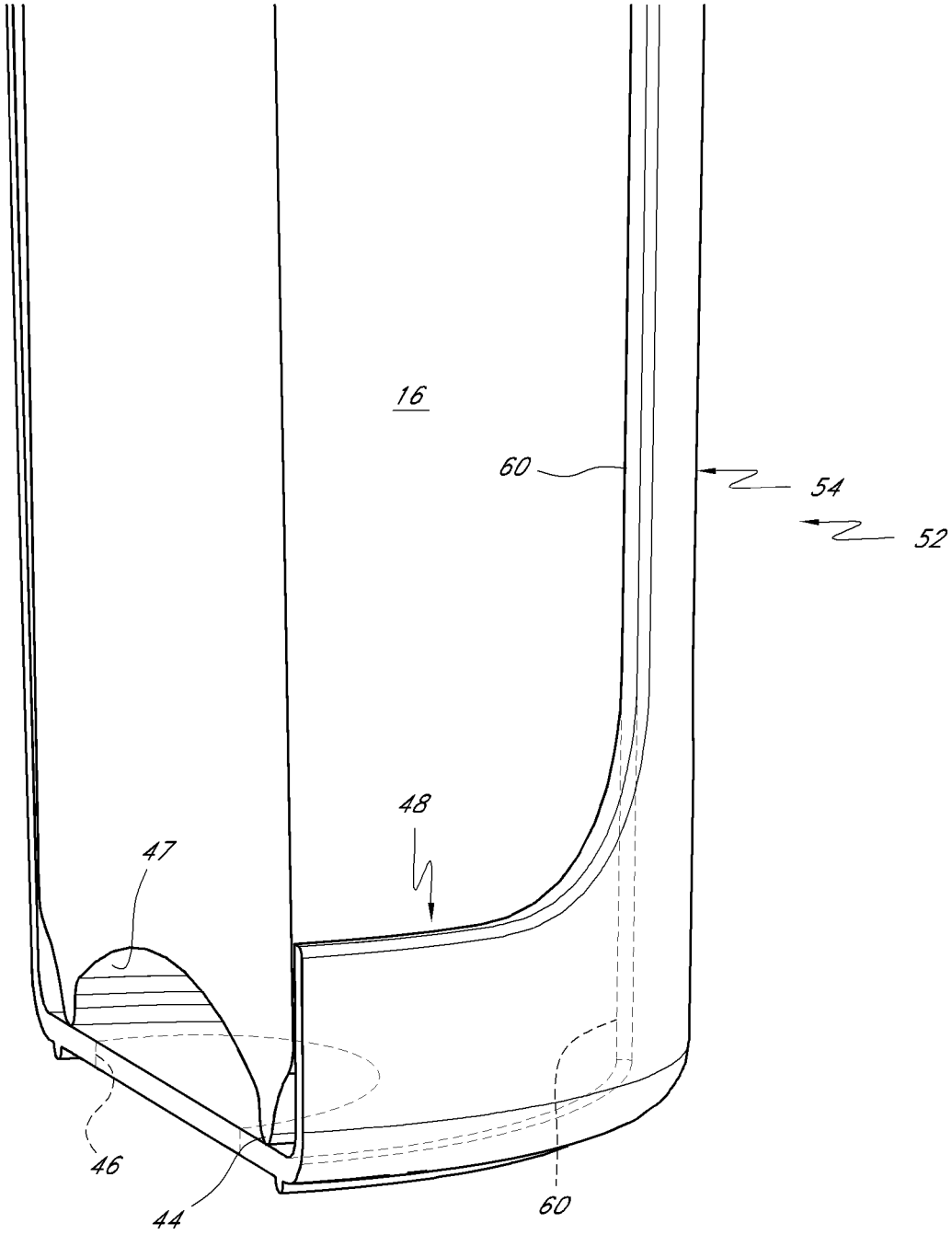
FIG. 4 is a partial sectional view of a lower end of the dispenser illustrated in FIG. 1.
Figure 5:
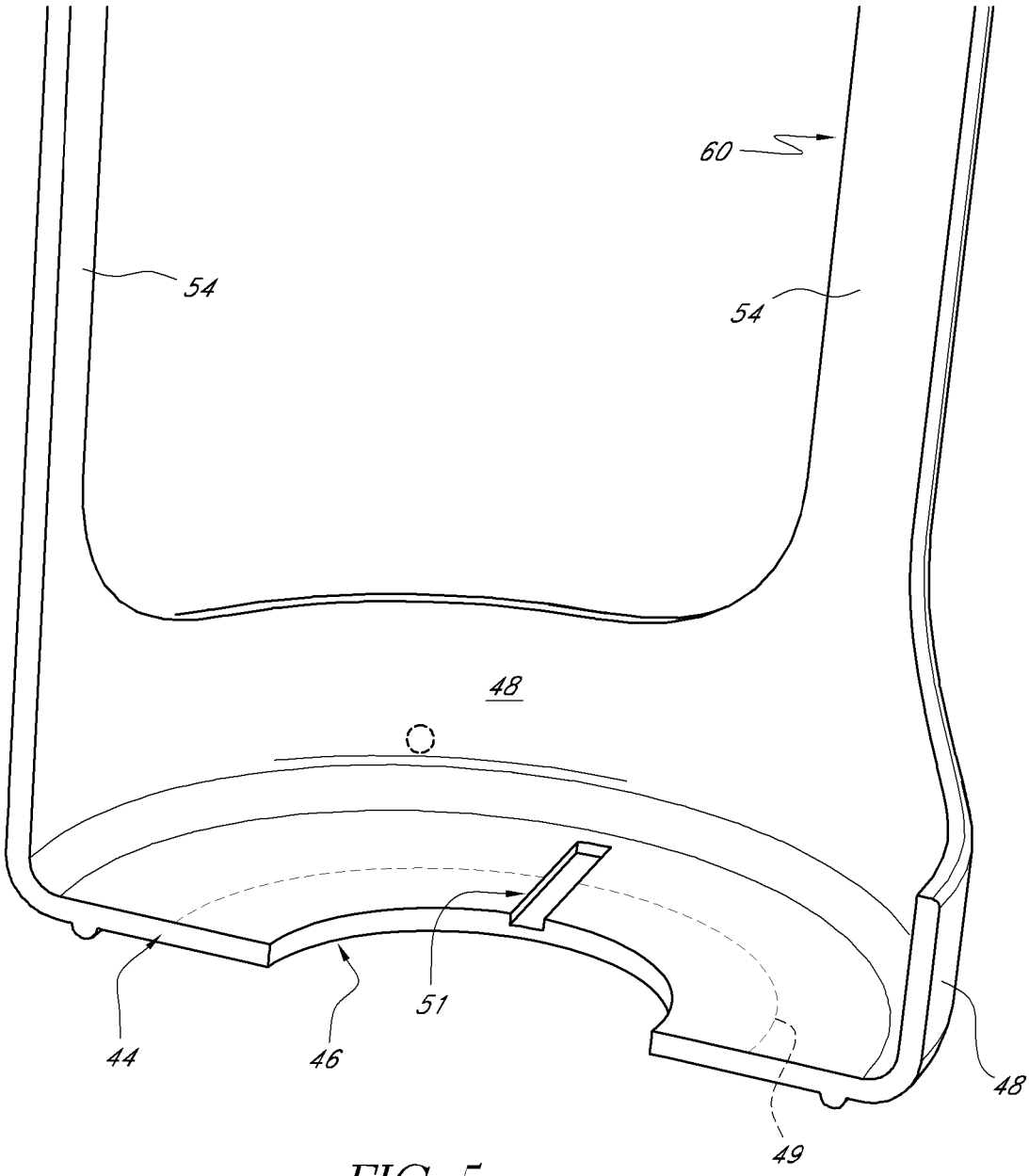
FIG. 5 is another partial sectional view of a lower end of the dispenser illustrated in FIG. 1, and including a drain.

As noted above, water or other liquids can accumulate between the peripheral wall 48 and the side of the container 16 (FIG. 4). Thus, in some embodiments, the dispenser 10 can be configured to allow such liquid pass across the contact area.

For example, in some embodiments, the surface 44 can include a drain 51. In some embodiments, the drain 51 can be in the form of a channel disposed in the surface 44 and extending across the contact area 49. Water trapped between the peripheral wall 48 and the side wall of the container 16 can flow downwardly into the drain 51, under the lower edge of the container 16 contacting the contact area 49, and toward the opening 46. As such, this water can drain out of the dispenser 10 more quickly.

With reference again to FIG. 4, in some embodiments, the peripheral wall 48 can be omitted (as illustrated in phantom line). Omitting the peripheral wall 48 can provide further advantages. For example, if the dispenser 10 is partially submerged in an ice-water bath, and water flows into the lower portion 12, as noted above, the peripheral wall 48 can retain some of that water when the dispenser is raised out of the bath. Thus, when a user, such as a bartender, tips the dispenser over to pour out the contents of the container 16 into a cocktail glass, the water retained by the peripheral wall 48 will spill out onto the bar or possibly into the cocktail glass. Thus, eliminating the peripheral wall 48 reduces or eliminates such spillage.

With reference to FIG. 2, in some embodiments, the lower portion 12 can include a connector 50 at its upper end and at least one connection member 52 structurally connecting the lower surface 44 with the connector 50. In some embodiments, the connector members 52 are in the form of struts 54. However, this is merely one type of connector that can be used as the connector member 52.

Generally, the connector member 52, in operation, will only be subjected to tensile forces. Thus, the connector 52 can take any form, such as, for example, but without limitation, cable, chain, strap, or any other device or structure that can provide resistance against tensile forces. In the illustrated embodiment, the dispenser 10 includes three struts 54. However, any number of struts can be used.

A further advantage is provided where the connector member 52 is configured so as to provide for a free flow of fluid, such as ice water or air, into thermal communication with an outer surface of the container 16. In the illustrated embodiment, the arrangement of the three struts 54 creates three large openings 60 around the periphery of the lower portion 12.

Such a construction can allow fluids, such as ice water or refrigerated air, to freely flow into thermal contact with the outer surface of the container 16. As such, when the container 16 is held within the dispenser 10, the container 16 can be readily cooled in any manner, such as an ice water bath, a refrigerator, or any other cooling method.

In some embodiments, the size of the openings 60 can be maximized so as to allow for the maximum thermal communication between the walls of the container 16 and the surrounding fluid. The larger the openings 60, the higher the flow rate of fluid through the openings 60 and thus, the higher the rate thermal transfer between the liquid in the container 16 the fluid surrounding the container 16.

Additionally, the openings 60 allow a user to easily see the sides of the container 26 which will often include some type of description of the contents of the container 16. This is advantageous in the environment of many types of on-premises establishments that are use low lighting which can make it more difficult for bartenders to see the labels on such containers. The label on a container 16 might indicate that the contents are a diet version of one particular liquid, but otherwise using the same logos and trademarks as the non-diet version of that liquid. Thus, using large openings 60 allows the bartenders to more easily see the labels on the container 16, even in low light conditions and help prevent accidental mix-ups of cocktail ingredients.

Thus, in some embodiments, the dimensions used for the connector members 52 can be minimized according to the minimum material thicknesses needed to withstand the tensile forces generated by the dispenser 10 when fully assembled. This allows the openings 60 to be made as large as possible.

With continued reference to FIG. 2, the connector 50 can be any type of connector. In the illustrated embodiment, the connector 50 includes internal threads on an inwardly facing surface thereof. These threads are configured to engage with external threads on a lower end of the upper portion 14. However, any type of connection can be used.

As noted above, the upper portion 14 can have a lower end 70 that is configured to engage with the connector 50. In the illustrated embodiment, the lower end 70 includes a connector 72 which can be in the form of threads (not shown) configured to engage with internal threads in the connector 50. These threads can be of any type, for example, national coarse or national fine, or have any other pitch and size. In some embodiments, other connectors are used, including but not limited to, an interference fit, slip fit, latches, or any other connector. As such, the upper portion 14 can be releasably engaged with the lower portion 12. In some embodiments, the connection between the connector 50 and the connector 72 can have sufficient strength to prevent carbonation from escaping the container 16, described below in greater detail.

Figure 6:
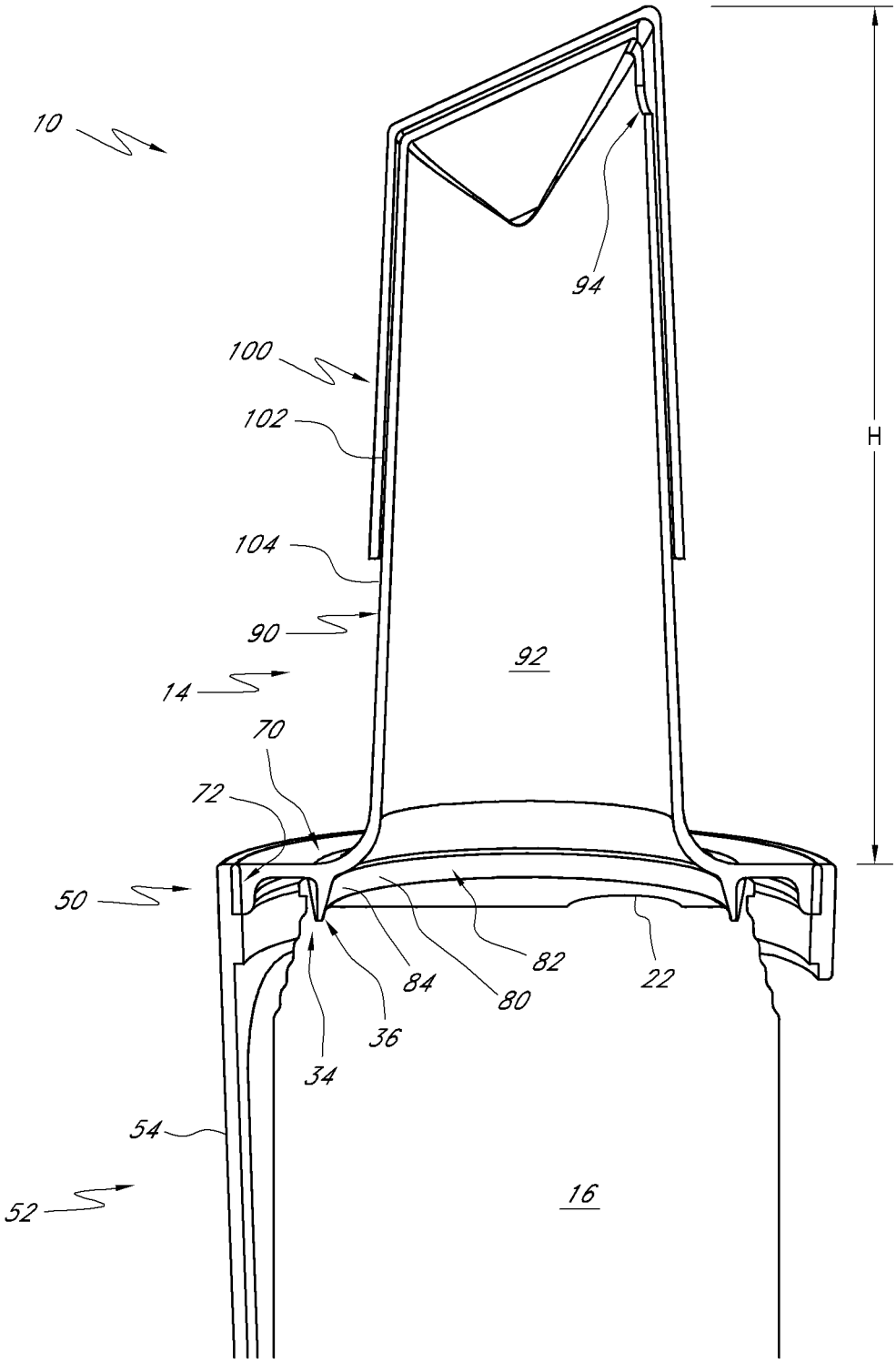
FIG. 6 is a partial sectional view of an upper end of the dispenser illustrated in FIG. 1.

With reference to FIG. 6, the upper portion 14 can also include a sealing arrangement 80 that is configured to form a seal with the channel 34 on the top of the container 16. The seal arrangement 80 can take any form. In the illustrated embodiment, the seal arrangement 80 includes an annular wall 82 extending downwardly from the lower end 70 of the upper portion 14.

The wall 82 can be made from any material. In some embodiments, the wall 82 can be made monolithically with the remainder of the upper portion 14 or it can be made from separate pieces connected to the remainder of the upper portion 14. In the illustrated embodiment, the annular wall 82 is made monolithically with the lower portion 70 of the upper portion 14. In other words, it is molded as a portion of the upper portion 14. Additionally, in this embodiment, the annular wall 82 is sized such that an inwardly facing surface 84 of the annular wall 82 contacts the outwardly facing surface 36 of the channel 34.

With this configuration, when the upper portion 14 is connected as a lower portion 12 through the interaction of the connectors 50, 72, tension is generated in the connector member 52 so as to pull the annular wall 84 downwardly into the channel 34 to thereby create a seal between the inner surface 84 and the outwardly facing surface 36 and/or other portions of the channel 34.

Other configurations can also be used. For example, the wall 84 can be arranged to contact other parts of the channel 34 or other parts of the container 16 around the opening 22. For example, some cans, such as large pineapple juice cans, do not have a deep channel 34. Thus, in some embodiments, the wall 84 can be configured to press against an upstanding wall 30, which is the type of wall that exists on the typical pineapple juice can. In this type of environment of use, the wall 84 does not need to generate a seal that is sufficiently strong to maintain carbonation in the associated container.

However, as noted above, the seal generated by the wall 84 can be configured to be sufficiently strong to prevent carbonation within a carbonated liquid disposed in the container 16 from escaping the dispenser 10. As such, the carbonation can be better maintained within such a carbonated liquid disposed in the container 16.

In some embodiments, the upper portion can include an elongated neck 90. The elongated neck 90 can have a height H configured to allow a human user to easily grasp the elongated neck 90. For example, the height H can be about 4-6 inches. However, this is merely an exemplary dimension. Any height can be used.

With continued reference to FIG. 6, the elongated neck 90 can define an interior conduit 92 and an upper outlet opening 94. As such, liquid from the container 16 can flow out of the container 16, through the opening 22, through the conduit 92, and out of the opening 94.

Thus, a user of the dispenser 10 can grab the elongated neck 90 and pour liquid out of the container 16 and through the outlet 94. In some embodiments, the conduit 92 can be restricted, to thereby reduce the interior volume of the conduit 92 which can aid in maintaining the level of carbonation in the carbonated liquid within the container 16.

Additionally, the dispenser 10 can include a cap 100. The cap 100 can be configured to fit tightly over a top portion of the elongated neck 90. Additionally, an interior surface 102 of the cap 100 can be configured to form a gas tight seal with an outer surface 104 of the elongated neck 90.

For example, the surfaces 102, 104 can be configured to form a slip fit such that when the cap 100 is disposed on the neck 90, as illustrated in FIG. 6, the surfaces 102, 104 contact each other and thereby generate a seal. In some embodiments, the surfaces 102, 104 can include ridges (not shown) or other surface features configured to form an interference fit. Regardless of the type of technique used to generate a seal between the surfaces 102, 104, the seal can be configured to be sufficiently strong to retain carbonation within the carbonated liquid disposed within the container 16.

With reference to FIG. 1, the neck 90 can include a recess 110 disposed on an upper end thereof, adjacent to the outlet opening 94. Additionally, the cap 100 can include a complimentarily-shaped recess 112. In some embodiments, the recesses 110, 112 can be arranged so as to nest with each other when the cap 100 is connected to the neck 90. Such a nesting of the recesses 110, 112 can provide for a positive engagement of the cap 100 with the neck 90 when the cap 100 is oriented in the correct position to provide the desired seal therebetween. Additionally, in some embodiments, the cap 100 can be tethered to a portion of the dispenser so as to prevent the cap 100 from being lost.

In use, for example, in an on-premises establishment such as a bar or night club, when a customer orders a cocktail with an ingredient that is not in the bartenders hose-dispenser, the bartender must open another type of container. Many such cocktail ingredients are delivered to the on-premises establishment in a can, such as a soda can or a juice can (e.g., pineapple juice). Thus, the bartender opens a can such as container 16.

Because the container 16 contains a sufficient amount of ingredient to make more than one cocktail, after the bartender makes one cocktail, the bartender inserts the container 16 into the lower portion 12, as illustrated in FIG. 2. The bartender then attaches the upper portion 14 to the lower portion 12 by connecting the connectors 50 and 70 to each other. As the connectors 50, 70 are brought into engagement with each other, the surface 44 abuts against the lower surface of the container 16. This movement also brings the wall 84 into a sealing engagement with the wall 36 (FIG. 6).

In this configuration, the cap 100 seals the opening 94 and thus any liquid in the container 16 is preserved. For example, if the liquid is a juice, the cap 100 helps to keep the juice fresh. Additionally, if the liquid is a carbonated beverage, the cap 100 prevents or slows the loss of carbonation from the liquid.

The bartender can then place the dispenser in an cooled environment, such as a refrigerator or an ice-water bath. The openings 60 in the sides of the dispenser 10 allow the cooled fluid, whether it is cooled air from a refrigerator or water from an ice-water bath, to freely flow into thermal communication with the sides of the container, and thus with any liquid in the container 16. As such, the liquid can be further preserved and maintained at the desired temperature.

When another customer orders a cocktail with the same ingredient, the bartender can remove the dispenser from the cooled environment. If the cooled environment is an ice-water bath, the water can drain out of the opening 46 (FIG. 2), drain 45 (FIG. 5), through the drain 51, and/or through the opening 60 where the peripheral wall 48 has been omitted (FIG. 4). The bartender can also remove the cap 100 and pour the liquid ingredient from the container 16 and into a cocktail glass. However, other methods can also be performed with the dispenser.

Any features of the embodiments show and/or described in the figures that have not been expressly described in this text, such as distances, proportions of components etc. are also intended to form part of this disclosure. Additionally, although these inventions have been disclosed in the context of certain various embodiments, features, aspects, and examples, it will be understood by those skilled in the art that the present inventions extend beyond the specifically disclosed embodiments to other alternative embodiments under uses of the inventions and obvious modifications and equivalents thereof. Accordingly, it should be understood that the various features and aspects of the disclosed embodiments can be combined with, or substituted for, one another in order to perform varying modes of the disclosed inventions. Thus, it is intended that the scope of the present inventions herein disclosed should not be limited by the particular disclosed embodiments described above.

What is claimed is:

1. A canned cocktail ingredient dispenser for a metal can containing a carbonated cocktail ingredient, the metal can comprising a top portion and a frangible portion disposed on the top portion and configured to allow a user to open the top portion, the dispenser comprising:

a top tensioning member having a first connector, the top tensioning member including an outlet opening and a sealing arrangement configured to form a seal with the top portion of the metal can around the frangible portion;

a cap configured to slow the loss of carbonation from the carbonated cocktail ingredient via the outlet opening;

a bottom tensioning member having a bottom abutment portion configured to abut against a bottom of the metal can;

a second connector configured to releasably engage the first connector;

a plurality of struts connecting the bottom abutment portion and the second connector; and a middle portion disposed between the bottom abutment portion and the second connector, the top tensioning member and the bottom tensioning member and the first and second connectors being arranged such that the bottom tensioning member presses the top portion of the metal can into engagement with the seal on the top tensioning member with sufficient force so as to maintain a gas tight seal between the seal and the top portion of the can that is sufficiently strong to maintain the carbonation in the can, the middle portion being open such that fluid can freely flow into thermal communication with portions of the metal can below the seal.

2. The ingredient dispenser according to claim 1 additionally comprising an elongated neck disposed on the top tensioning member, the elongated neck sized to be graspable by a human hand and the elongated neck having a conduit ending at the outlet opening on a distal end of the elongated neck, the conduit being configured to allow the carbonated cocktail ingredient to flow from the can, through the conduit, and out through the outlet opening.

3. The ingredient dispenser according to claim 2 wherein the cap is configured to form a seal over the outlet opening, the seal being sufficiently strong to slow the loss of carbonation from the carbonated cocktail ingredient.

4. The ingredient dispenser according to claim 3, wherein the cap is configured to form a gas tight seal over the outlet opening.

5. The liquid dispenser according to claim 1, wherein the bottom abutment portion includes an opening configured to allow the fluid in thermal communication with portions of the metal can to flow out of the opening.

6. A canned cocktail ingredient dispenser for a metal can containing a carbonated cocktail ingredient, the metal can comprising a top portion and a frangible portion disposed on the top portion and configured to allow a user to open the top portion, the dispenser comprising:

a top tensioning member having a first connector, the top tensioning member including a sealing arrangement configured to form a seal with the top portion of the metal can around the frangible portion;

a bottom tensioning member having a bottom abutment portion comprising an opening such that liquid can flow out of the opening in the bottom abutment portion, the bottom abutment portion configured to abut against a bottom of the metal can;

a second connector configured to releasably engage the first connector; and a middle portion disposed between the bottom abutment portion and the second connector, the top tensioning member and the bottom tensioning member and the first and second connectors being arranged such that the bottom tensioning member presses the top portion of the metal can into engagement with the seal on the top tensioning member with sufficient force so as to maintain a connection between the seal and the top portion of the can that is sufficiently strong to maintain the carbonation in the can, the middle portion being open such that fluid can freely flow into thermal communication with portions of the metal can below the seal;

wherein the opening in the bottom abutment portion is configured such that liquid entering the bottom tensioning member through the open middle portion can flow out of the opening in the bottom abutment portion.

7. The canned cocktail ingredient dispenser according to claim 6, additionally comprising a cap configured to form a seal over an outlet opening of the top tensioning member, the seal being sufficiently strong to slow the loss of carbonation from the carbonated cocktail ingredient.

8. The canned cocktail ingredient dispenser according to claim 7, wherein the cap is configured to form a gas tight seal over the outlet opening.

9. A carbonated liquid dispenser comprising:

a top member including a seal configured to form a gas tight seal with a top portion of a carbonated liquid container and around an opening in the top portion of the carbonated liquid container;

a bottom member having a bottom portion configured to abut against a bottom of the carbonated liquid container; and a middle portion connecting the bottom member and the top member, the middle portion comprising struts and being open such that liquid can freely flow into thermal communication with portions of the carbonated liquid container, wherein the bottom portion includes an opening such that water entering bottom member through the open middle portion can flow out of the opening in the bottom portion.

10. The liquid dispenser according to claim 9 additionally comprising an elongated neck disposed on the top member, the elongated neck sized to be graspable by a human hand, the elongated neck having a conduit ending at an outlet opening on a distal end of the elongated neck, the conduit being configured to allow liquid from a carbonated liquid container disposed between the bottom member and the top member, to flow through the conduit and out through the outlet opening.

11. The liquid dispenser according to claim 10 additionally comprising a cap configured to form a seal over the outlet opening, the seal being sufficiently strong to slow the loss of carbonation from the carbonated liquid container.

12. A method of sealing an opened carbonated liquid container, the method comprising:

inserting the carbonated liquid container into a bottom member which includes at least one openings in a side thereof;

abutting a bottom portion of the bottom member against a bottom of the carbonated liquid container;

connecting a top member to the bottom member with the carbonated liquid container disposed between the top and bottom members;

applying tension to the top member and the bottom member via a plurality of struts such that a gas tight seal is formed between the top member and a top of the carbonated liquid container, the seal being positioned around an opening in the top of the carbonated liquid container; and inserting at least the bottom member into a cooled fluid such that the cooled fluid flows through the at least one opening and into thermal communication with the carbonated liquid container.

13. The method according to claim 12 additionally comprising placing a cap over an opening in the top member.

14. The method according to claim 13, wherein the cap is configured to form a seal over the opening, the seal being sufficiently strong to slow the loss of carbonation from the carbonated cocktail ingredient.

15. The method according to claim 14, wherein the cap is configured to form a gas tight seal over the opening.

16. The method according to claim 12, wherein the bottom portion includes a drain aperture configured to allow the cooled fluid to flow out of the drain aperture.

17. A canned cocktail ingredient dispenser for a beverage container containing a carbonated cocktail ingredient, the beverage container comprising a top portion having a peripheral channel and a frangible portion configured to allow a user to open the top portion, the dispenser comprising:

an upper portion comprising a sealing arrangement, the sealing arrangement configured to form a seal with the peripheral channel of the beverage container, the sealing arrangement comprising an annular wall configured to be at least partly received in the peripheral channel;

a lower portion configured to abut a bottom portion of the beverage container; and a plurality of connection members configured to couple with the upper portion and the lower portion, wherein such coupling generates tension in the connector members and pulls the annular wall at least partly into the peripheral channel to thereby create the seal, the seal being disposed between the annular wall and the peripheral channel.

18. The canned cocktail ingredient dispenser of claim 17, wherein the downwardly extending annular wall is monolithic with the remainder of the upper portion.

19. The canned cocktail ingredient dispenser of claim 18, wherein the downwardly extending annular wall is molded as a portion of the upper portion.

20. The canned cocktail ingredient dispenser of claim 17, wherein the upper portion further comprising a radially outwardly extending annular portion, the annular portion coupled with the annular wall.

21. The canned cocktail ingredient dispenser of claim 17, wherein the annual wall contacts an inner surface of the peripheral channel.

22. The canned cocktail ingredient dispenser of claim 17, wherein the annual wall is tapered.

* * * * *